US009796071B2

(12) United States Patent
Liu et al.

(10) Patent No.: US 9,796,071 B2
(45) Date of Patent: Oct. 24, 2017

(54) SPRING RESET DEVICE FOR PISTON MECHANISM

(71) Applicant: Taizhou Dajiang Ind. Co., Ltd., Wenling, Zhejiang Province (CN)

(72) Inventors: Gui-Wen Liu, Wenling (CN); Ming-Jun Yang, Wenling (CN); Jin-Quan Huang, Wenling (CN)

(73) Assignee: TAIZHOU DAJIANG IND. CO., LTD., Wenling, Zhejiang (CN)

( * ) Notice: Subject to any disclaimer, the term of this patent is extended or adjusted under 35 U.S.C. 154(b) by 508 days.

(21) Appl. No.: 14/550,288

(22) Filed: Nov. 21, 2014

(65) Prior Publication Data

US 2016/0023340 A1 Jan. 28, 2016

(30) Foreign Application Priority Data

Jul. 24, 2014 (CN) ..... 2014 1 0356491
Jul. 24, 2014 (CN) ..... 2014 2 0411698 U

(51) Int. Cl.
*B25C 1/04* (2006.01)
*B25C 5/00* (2006.01)

(52) U.S. Cl.
CPC ..... *B25C 1/047* (2013.01); *B25C 1/04* (2013.01); *B25C 5/00* (2013.01)

(58) Field of Classification Search
CPC .. B25C 1/00; B25C 1/04; B25C 1/043; B25C 1/044; B25C 1/047; B25C 1/06;
(Continued)

(56) References Cited

U.S. PATENT DOCUMENTS 2,624,047 A * 1/1953 Gaskill ..... B25C 5/16 227/133
2,987,047 A * 6/1961 Young ..... F01L 23/00 417/398

(Continued)

FOREIGN PATENT DOCUMENTS

CN 201231480 Y 5/2009
CN 204025226 U 12/2014
CN 204525370 U 8/2015

OTHER PUBLICATIONS

International Search Report issued by the State Intellectual Property Office of the Peoples Republic of China dated Sep. 30, 2015 for PCT/CN2015/082152.

*Primary Examiner* — Scott A Smith
(74) *Attorney, Agent, or Firm* — Tim Tingkang Xia, Esq.; Locke Lord LLP

(57) ABSTRACT

The present invention relates to a spring reset device for a piston mechanism. In certain embodiments, the spring reset device includes: a connecting plate, a pull rod, a plurality of reset springs, and a plurality of brackets. The connecting plate has a plurality of connecting pins. Each of the reset springs has a first end, and a second end. Each of the brackets has a connecting pin. The spring reset device is positioned on a top end of a piston body. The piston body includes a piston cylinder body, a piston plate, a piston rod, and a cylinder cover. A lower side of the piston plate is connected to the piston rod through a thread. First end of each of reset springs is rotatably connected to a hook portion of connecting plate. Second end of each of reset springs is rotatably connected a hook portion of a corresponding bracket.

18 Claims, 1 Drawing Sheet

(58) Field of Classification Search
CPC .. B25C 1/18; B25C 1/008; B25C 5/00; B25C 5/15; B25C 5/16
USPC ..... 227/8, 10, 130, 133, 132, 134, 140; 173/118, 121, 202, 203
See application file for complete search history.

(56) References Cited

U.S. PATENT DOCUMENTS

| | | | | | |
|---|---|---|---|---|---|
| 3,050,732 | A * | 8/1962 | Termet | B25C 1/105 | 227/10 |
| 3,394,766 | A * | 7/1968 | Lebelle | E02D 7/10 | 173/49 |
| 3,638,738 | A * | 2/1972 | Varnell | E02D 7/20 | 173/126 |
| 4,033,419 | A * | 7/1977 | Pennington | E21D 20/003 | 173/160 |
| 5,199,627 | A | 4/1993 | Christensen | | |
| 6,006,975 | A * | 12/1999 | Ishizawa | B25C 1/047 | 227/119 |
| 6,059,161 | A | 5/2000 | Chang et al. | | |
| 6,161,628 | A * | 12/2000 | Liu | B25D 9/20 | 173/114 |
| 6,371,348 | B1 * | 4/2002 | Canlas | B25C 1/008 | 123/46 SC |
| 6,394,332 | B2 * | 5/2002 | Akiba | B25C 1/008 | 227/130 |
| 9,216,502 | B2 * | 12/2015 | Brendel | B25C 1/06 | |
| 2010/0303552 | A1 * | 12/2010 | Yingling | E02D 7/02 | 405/232 |
| 2012/0097730 | A1 * | 4/2012 | Liang | B25C 1/044 | 227/130 |

* cited by examiner

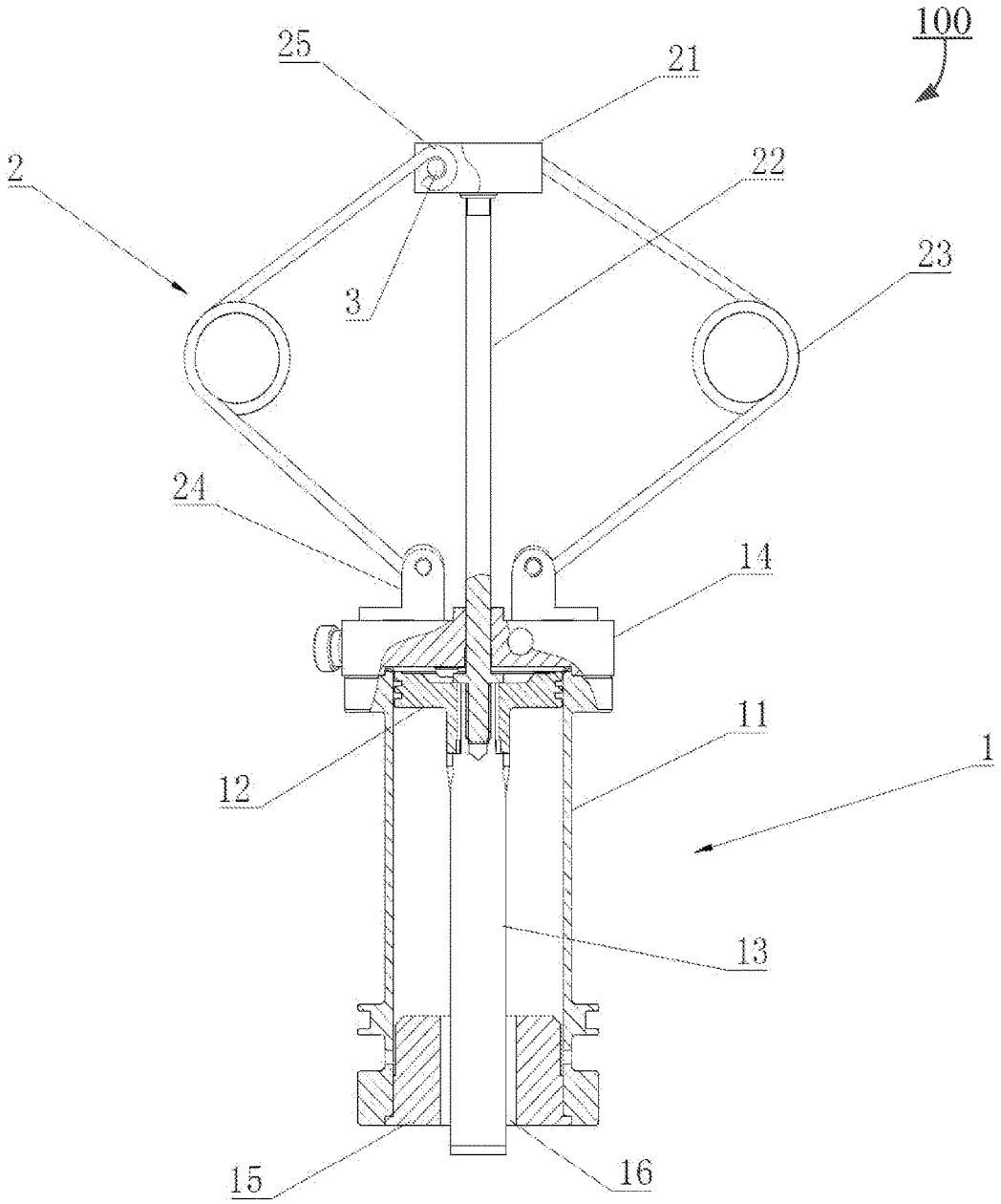
100
25
21
2
22
3
23
24
14
11
12
1
13
15
16

SPRING RESET DEVICE FOR PISTON MECHANISM

CROSS-REFERENCE TO RELATED APPLICATIONS

This application claims the priority to Chinese Patent Application No. 201410356491.3 and 201420411698.1, both filed on Jul. 24, 2014, in the State Intellectual Property Office of P.R. China, which are incorporated herein in their entireties by reference.

FIELD

The present invention mainly relates to the field of nail driving tool, and more particularly to a spring reset device for piston mechanism and a steam powered nailing gun having the spring reset device for piston mechanism.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A pneumatic nail gun generally uses a piston as a power driving device to drive a firing pin of a nail magazine. The piston is driven by air pressure, or hammer. The piston moves a certain distance at a high speed, and shoots a nail into place. Once the nail is shot, the piston needs to return to its original ready position in preparation for next nail shooting. Therefore, a return device is necessary to return of the piston to its ready position. Currently, most piston return devices have a complex structure, are not reliable, and cost of manufacture is high.

Therefore, heretofore unaddressed needs exist in the art to address the aforementioned deficiencies and inadequacies.

SUMMARY

In one aspect, the present invention relates to a spring reset device for a piston mechanism. In certain embodiments the spring reset device includes: a connecting plate, a pull rod, a plurality of reset springs, and a plurality of brackets. The connecting plate has an upper side and an opposite, lower side, and a plurality of connecting pins. The pull rod has a top end, and an opposite, bottom end. Each of the reset springs has a first end, and an opposite, second end. Each of the brackets has a connecting pin.

In certain embodiments, the spring reset device is positioned on a top end of a piston body. The piston body includes a piston cylinder body, a piston plate, a piston rod, and a cylinder cover. A lower side of the piston plate is connected to the piston rod through a thread.

In certain embodiments, the first end of each of the reset springs is connected to the connecting plate. The second end of each of the reset springs is connected a corresponding one of the brackets. The lower side of the connecting plate is fixedly connected to the pull rod. The brackets are fixedly connected to the cylinder cover of the piston body. The bottom end of the pull rod passes through the cylinder cover and extends into the piston cylinder body of the piston body.

In certain embodiments, the first end of each of the reset springs has a hook portion for rotatably connecting to a corresponding connecting pin of the connecting plate. The second end of each of the reset springs also has a hook portion for rotatably connecting to the connecting pin of a corresponding one of the brackets, respectively.

In one embodiment, the spring reset device has two reset springs, and two brackets. A set of reset spring and bracket is disposed one on one side of the pull rod, and another set of reset spring and bracket is disposed one on the opposite side of the pull rod. The reset springs includes at least one of a torsion spring and a stranded wire helical spring.

In certain embodiments, the top end of the pull rod is connected to the connecting plate through a thread, and the lower end of the pull rod is connected to the piston rod through another thread. A bottom end of the piston cylinder body includes a buffer block. The buffer block has a piston rod opening. The piston rod protrudes outside the piston cylinder body from the piston rod opening.

In another aspect, the present invention relates to a piston mechanism. The piston mechanism includes a piston body, and a spring reset device. In certain embodiments, the piston body has a top end and an opposite, bottom end, a piston cylinder body, a piston plate, a piston rod, and a cylinder cover. The spring reset device is disposed on the top end of the piston body. The spring reset device includes a connecting plate, a pull rod, a plurality of reset springs, and a plurality of brackets. The connecting plate has an upper side and an opposite, lower side, and a plurality of connecting pins. The pull rod has a top end, and an opposite, bottom end. Each of the reset springs has a first end, and an opposite, second end. Each of the brackets has a connecting pin.

In certain embodiments, the spring reset device is positioned on a top end of a piston body. The piston body includes a piston cylinder body, a piston plate, a piston rod, and a cylinder cover. A lower side of the piston plate is connected to the piston rod through a thread.

In certain embodiments, the first end of each of the reset springs is connected to the connecting plate. The second end of each of the reset springs is connected a corresponding one of the brackets. The lower side of the connecting plate is fixedly connected to the pull rod. The brackets are fixedly connected to the cylinder cover of the piston body. The bottom end of the pull rod passes through the cylinder cover and extends into the piston cylinder body of the piston body.

In certain embodiments, the first end of each of the reset springs has a hook portion for rotatably connecting to a corresponding connecting pin of the connecting plate. The second end of each of the reset springs also has a hook portion for rotatably connecting to the connecting pin of a corresponding one of the brackets, respectively.

In one embodiment, the spring reset device has two reset springs, and two brackets. A set of reset spring and bracket is disposed one on one side of the pull rod, and another set of reset spring and bracket is disposed one on the opposite side of the pull rod. The reset springs includes at least one of a torsion spring and a stranded wire helical spring.

In certain embodiments, the top end of the pull rod is connected to the connecting plate through a thread, and the lower end of the pull rod is connected to the piston rod through another thread. A bottom end of the piston cylinder body includes a buffer block. The buffer block has a piston rod opening. The piston rod protrudes outside the piston cylinder body from the piston rod opening.

In yet another aspect, the present invention relates to a steam powered nailing gun.

The steam powered nailing gun includes a piston mechanism, and the piston mechanism includes: has a top end and an opposite, bottom end, a piston cylinder body, a piston plate, a piston rod, and a cylinder cover. The spring reset device is disposed on the top end of the piston body. The spring reset device includes a connecting plate, a pull rod, a plurality of reset springs, and a plurality of brackets. The connecting plate has an upper side and an opposite, lower side, and a plurality of connecting pins. The pull rod has a top end, and an opposite, bottom end. Each of the reset springs has a first end, and an opposite, second end. Each of the brackets has a connecting pin.

In certain embodiments, the first end of each of the reset springs is connected to the connecting plate. The second end of each of the reset springs is connected a corresponding one of the brackets. The lower side of the connecting plate is fixedly connected to the pull rod. The brackets are fixedly connected to the cylinder cover of the piston body. The bottom end of the pull rod passes through the cylinder cover and extends into the piston cylinder body of the piston body.

In certain embodiments, the first end of each of the reset springs has a hook portion for rotatably connecting to a corresponding connecting pin of the connecting plate. The second end of each of the reset springs also has a hook portion for rotatably connecting to the connecting pin of a corresponding one of the brackets, respectively.

In certain embodiments, the top end of the pull rod is connected to the connecting plate through a thread, and the lower end of the pull rod is connected to the piston rod through another thread. A bottom end of the piston cylinder body includes a buffer block. The buffer block has a piston rod opening. The piston rod protrudes outside the piston cylinder body from the piston rod opening.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention, and wherein:

FIG. 1 is a schematic structural view and partial sectional view of a spring reset device for a piston mechanism according to certain embodiments of the present invention.

DETAILED DESCRIPTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present invention be fully understood, but the present invention may also be implemented by using other manners different from those described herein, so that the present invention is not limited by the specific embodiments disclosed in the following.

The description will be made as to the embodiments of the present invention in conjunction with the accompanying drawing FIG. 1. In accordance with the purposes of this invention, as embodied and broadly described herein, this invention, in one aspect, relates to a spring reset device 2 for a piston mechanism 100.

In certain embodiments, as shown in FIG. 1, the piston mechanism 100 includes a piston body 1 and a spring reset device 2 disposed on a top end of the piston body 1. The piston body 1 has a piston cylinder body 11, a piston plate 12, a piston rod 13, and a cylinder cover 14. The cylinder cover 14 is positioned on a top end of the piston cylinder body 11. The piston plate 12 is disposed inside the piston cylinder body 11 and is connected to the spring reset device 2 above the piston body 1. A lower side of the piston plate 12 is connected to the piston rod 13 through a thread.

In certain embodiments, a lower end of the piston cylinder body 11 is further provided with a buffer block 15 for cushioning impact of the piston plate 12, and a lower side of the piston plate 12 is connected to a firing pin of a nail magazine through threads. A lower end of the piston cylinder body 11 is further provided with a buffer block 15 for cushioning impact of the piston plate 12. In one embodiment, the buffer block 15 is made of a rubber or nylon material.

In certain embodiments, the spring reset device 2 has a connecting plate 21, a pull rod 22, a plurality of reset springs 23, and a plurality of brackets 24. The connecting plate 21 has an upper side and an opposite, lower side, and a plurality of connecting pins 3. The lower side of the connecting plate 21 is fixedly connected to the pull rod 22. The brackets 24 are fixedly connected to the cylinder cover 14 of the piston body 1. The pull rod 22 has a top end, and an opposite, bottom end. Each of the reset springs 23 has a first end, and an opposite, second end. Each of the brackets 24 has a connecting pin 3.

In certain embodiments, the first end of each of the reset springs 23 is connected to the connecting plate 21. The second end of each of the reset springs 23 is connected a corresponding one of the brackets 24. The lower side of the connecting plate 21 is fixedly connected to the pull rod 22. The brackets 24 are fixedly connected to the cylinder cover 14 of the piston body 1. The bottom end of the pull rod 22 passes through the cylinder cover 14 and extends into the piston piston cylinder body 11 of the piston body 1.

In certain embodiments, the first end of each of the reset springs 23 has a hook portion 25 for rotatably connecting to a corresponding connecting pin 3 of the connecting plate 21. The second end of each of the reset springs 23 also has a hook portion 25 for rotatably connecting to the connecting pin 3 of a corresponding one of the brackets 24, respectively.

In one embodiment, the spring reset device 2 has two reset springs 23, and two brackets 24. A set of reset spring 23 and bracket 24 is disposed one on one side of the pull rod 22, and another set of reset spring 23 and bracket 24 is disposed one on the opposite side of the pull rod 22. In another embodiment, the spring reset device 2 has four sets of reset spring 23, and bracket 24. The reset springs 23 includes at least one of a torsion spring and a stranded wire helical spring.

In certain embodiments, the top end of the pull rod 22 is connected to the connecting plate 21 through a thread, and the lower end of the pull rod 22 is connected to the piston rod 13 through another thread. A bottom end of the piston cylinder body 11 includes a buffer block 15. The buffer block 15 has a piston rod opening 16. The piston rod 13 protrudes outside the piston cylinder body 11 from the piston rod opening 16.

The operation of the spring reset device 2 is described as following: once the piston rod 13 is pushed and moved to the bottom of the piston cylinder body 11 to drive a nail, the piston rod 13 needs to return to its original ready position for next nailing action. Therefore, the spring reset device 2 is required to assist the piston rod 13 to return to its original ready position. When an external force (for example, high-pressure air, steam power, or other mechanical power) is applied to the connecting plate 21, the piston rod 13 moves to the bottom of the piston cylinder body 11. The pull rod 22 also moves downwards along with the piston rod 13. The reset springs 23 are compressed. When the external force is lifted, the pull rod 22 moves upwards under the resilient force of the reset spring 23 to return to an initial position, so as to drive the piston rod 13 to move upwards to return to the top of the piston cylinder body 11, thereby preparing for a next action.

In another aspect, the present invention relates to a piston mechanism 100. The piston mechanism 100 includes a piston body 1, and a spring reset device 2. In certain embodiments, the piston body 1 has a top end and an opposite, bottom end, a piston cylinder body 11, a piston plate 12, a piston rod 13, and a cylinder cover 14. The spring reset device 2 is disposed on the top end of the piston body 1. The spring reset device 2 includes a connecting plate 21, a pull rod 22, a plurality of reset springs 23, and a plurality of brackets 24. The connecting plate 21 has an upper side and an opposite, lower side, and a plurality of connecting pins 3. The pull rod 22 has a top end, and an opposite, bottom end. Each of the reset springs 23 has a first end, and an opposite, second end. Each of the brackets 24 has a connecting pin 3.

In certain embodiments, the spring reset device 2 is positioned on a top end of a piston body 1. The piston body 1 includes a piston cylinder body 11, a piston plate 12, a piston rod 13, and a cylinder cover 14. A lower side of the piston plate 12 is connected to the piston rod 13 through a thread.

In certain embodiments, the first end of each of the reset springs 23 is connected to the connecting plate 21. The second end of each of the reset springs 23 is connected a corresponding one of the brackets 24. The lower side of the connecting plate 21 is fixedly connected to the pull rod 22. The brackets 24 are fixedly connected to the cylinder cover 14 of the piston body 1. The bottom end of the pull rod 22 passes through the cylinder cover 14 and extends into the piston cylinder body 11 of the piston body 1.

In certain embodiments, the first end of each of the reset springs 23 has a hook portion 25 for rotatably connecting to a corresponding connecting pin 3 of the connecting plate 21. The second end of each of the reset springs 23 also has a hook portion 25 for rotatably connecting to the connecting pin 3 of a corresponding one of the brackets 24, respectively.

In one embodiment, the spring reset device 2 has two reset springs 23, and two brackets 24. A set of reset spring 23 and bracket 24 is disposed one on one side of the pull rod 22, and another set of reset spring 23 and bracket 24 is disposed one on the opposite side of the pull rod 22. The reset springs 23 includes at least one of a torsion spring and a stranded wire helical spring.

In certain embodiments, the top end of the pull rod 22 is connected to the connecting plate 21 through a thread, and the lower end of the pull rod 22 is connected to the piston rod 13 through another thread. A bottom end of the piston cylinder body 11 includes a buffer block 15. The buffer block 15 has a piston rod opening 16. The piston rod 13 protrudes outside the piston cylinder body 11 from the piston rod opening 16.

In yet another aspect, the present invention relates to a steam powered nailing gun. The steam powered nailing gun includes a piston mechanism 100, and the piston mechanism 100 includes: has a top end and an opposite, bottom end, a piston cylinder body 11, a piston plate 12, a piston rod 13, and a cylinder cover 14. The spring reset device 2 is disposed on the top end of the piston body 1. The spring reset device 2 includes a connecting plate 21, a pull rod 22, a plurality of reset springs 23, and a plurality of brackets 24. The connecting plate 21 has an upper side and an opposite, lower side, and a plurality of connecting pins 3. The pull rod 22 has a top end, and an opposite, bottom end. Each of the reset springs 23 has a first end, and an opposite, second end. Each of the brackets 24 has a connecting pin 3.

In certain embodiments, the first end of each of the reset springs 23 is connected to the connecting plate 21. The second end of each of the reset springs 23 is connected a corresponding one of the brackets 24. The lower side of the connecting plate 21 is fixedly connected to the pull rod 22. The brackets 24 are fixedly connected to the cylinder cover 14 of the piston body 1. The bottom end of the pull rod 22 passes through the cylinder cover 14 and extends into the piston cylinder body 11 of the piston body 1.

In certain embodiments, the first end of each of the reset springs 23 has a hook portion 25 for rotatably connecting to a corresponding connecting pin 3 of the connecting plate 21. The second end of each of the reset springs 23 also has a hook portion 25 for rotatably connecting to the connecting pin 3 of a corresponding one of the brackets 24, respectively.

In certain embodiments, the top end of the pull rod 22 is connected to the connecting plate 21 through a thread, and the lower end of the pull rod 22 is connected to the piston rod 13 through another thread. A bottom end of the piston cylinder body 11 includes a buffer block 15. The buffer block 15 has a piston rod opening 16. The piston rod 13 protrudes outside the piston cylinder body 11 from the piston rod opening 16.

The power supply required in the present invention may be a domestic or industrial alternating current, or may be provided by a rechargeable battery.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent tothose skilled in the art to which the present invention pertains without departing from its spirit and scope. Accordingly, the scope of the present invention is defined by the appended claims, the foregoing description and the exemplary embodiments described therein, and accompanying drawings.

What is claimed is:

1. A spring reset device for a piston mechanism, comprising:

a connecting plate having an upper side and an opposite, lower side, and a plurality of connecting pins;

a pull rod having a top end, and an opposite, bottom end;

a plurality of reset springs, each having a first end, and an opposite, second end; and a plurality of brackets, each of the plurality of brackets having a connecting pin;

wherein the spring reset device is disposed on a top end of a piston body, the first end of each of plurality of reset springs is connected to the connecting plate, the second end of each of the plurality of reset springs is connected a corresponding one of the plurality of brackets, the lower side of the connecting plate is fixedly connected to the pull rod, the plurality of brackets is fixedly connected to a cylinder cover of the piston body, and the bottom end of the pull rod passes through the cylinder cover to extend into a piston cylinder body of the piston body.

2. The spring reset device according to claim 1, wherein the piston body comprises a piston cylinder body, a piston plate, a piston rod, and a cylinder cover, wherein a lower side of the piston plate is threadedly connected to the piston rod.

3. The spring reset device according to claim 2, wherein the first end of each of the plurality of reset springs includes a hook portion for rotatably connecting to a corresponding connecting pin of the connecting plate, and the second end of each of the plurality of reset springs includes a hook portion for rotatably connecting to the connecting pin of a corresponding bracket, respectively.

4. The spring reset device according to claim 3, wherein the plurality of reset springs comprises two reset springs, disposed one on each side of the pull rod.

5. The spring reset device according to claim 4, wherein the plurality of reset springs comprises at least one of a torsion spring and a stranded wire helical spring.

6. The spring reset device according to claim 5, wherein the top end of the pull rod is threadedly connected to the connecting plate, and the lower end of the pull rod is threadedly connected to the piston rod.

7. The spring reset device according to claim 6, wherein a bottom end of the piston cylinder body comprises a buffer block, the buffer block comprises a piston rod opening, and the piston rod protrudes outside the piston cylinder body from the piston rod opening.

8. A piston mechanism comprising:

a piston body having a top end and an opposite, bottom end, a piston cylinder body, a piston plate, a piston rod, and a cylinder cover; and a spring reset device, disposed on the top end of the piston body, wherein the spring reset device comprises:

connecting plate having an upper side and an opposite, lower side, and a plurality of connecting pins;

a pull rod having a top end, and an opposite, bottom end;

a plurality of reset springs, each having a first end, and an opposite, second end; and a plurality of brackets, each of the plurality of brackets having a connecting pin;

wherein the first end of each of plurality of reset springs is connected to the connecting plate, the second end of each of the plurality of reset springs is connected a corresponding one of the plurality of brackets, the lower side of the connecting plate is fixedly connected to the pull rod, the plurality of brackets is fixedly connected to the cylinder cover of the piston body, and the bottom end of the pull rod passes through the cylinder cover to extend into the piston cylinder body of the piston body.

9. The piston mechanism according to claim 8, wherein a lower side of the piston plate is threadedly connected to the piston rod.

10. The piston mechanism according to claim 9, wherein the first end of each of the plurality of reset springs includes a hook portion for rotatably connecting to a corresponding connecting pin of the connecting plate, and the second end of each of the plurality of reset springs includes a hook portion for rotatably connecting to the connecting pin of a corresponding bracket, respectively.

11. The piston mechanism according to claim 10, wherein the plurality of reset springs comprises two reset springs, disposed one on each side of the pull rod.

12. The piston mechanism according to claim 11, wherein the plurality of reset springs comprises at least one of a torsion spring and a stranded wire helical spring.

13. The piston mechanism according to claim 12, wherein the top end of the pull rod is threadedly connected to the connecting plate, and the lower end of the pull rod is threadedly connected to the piston rod.

14. The piston mechanism according to claim 13, wherein a bottom end of the piston cylinder body comprises a buffer block, the buffer block comprises a piston rod opening, and the piston rod protrudes outside the piston cylinder body from the piston rod opening.

15. A steam powered nailing gun comprising a piston mechanism, wherein the piston mechanism comprises:

a piston body having a top end and an opposite, bottom end, a piston cylinder body, a piston plate, a piston rod, and a cylinder cover; and a spring reset device, disposed on the top end of the piston body, wherein the spring reset device comprises:

connecting plate having an upper side and an opposite, lower side, and a plurality of connecting pins;

a pull rod having a top end, and an opposite, bottom end;

a plurality of reset springs, each having a first end, and an opposite, second end; and a plurality of brackets, each of the plurality of brackets having a connecting pin;

wherein the first end of each of plurality of reset springs is connected to the connecting plate, the second end of each of the plurality of reset springs is connected a corresponding one of the plurality of brackets, the lower side of the connecting plate is fixedly connected to the pull rod, the plurality of brackets is fixedly connected to the cylinder cover of the piston body, and the bottom end of the pull rod passes through the cylinder cover to extend into the piston cylinder body of the piston body.

16. The steam powered nailing gun according to claim 15, wherein the first end of each of the plurality of reset springs includes a hook portion for rotatably connecting to a corresponding connecting pin of the connecting plate, and the second end of each of the plurality of reset springs includes a hook portion for rotatably connecting to the connecting pin of a corresponding bracket, respectively.

17. The steam powered nailing gun according to claim 16, wherein the top end of the pull rod is threadedly connected to the connecting plate, and the lower end of the pull rod is threadedly connected to the piston rod.

18. The steam powered nailing gun according to claim 17, wherein a bottom end of the piston cylinder body comprises a buffer block, the buffer block comprises a piston rod opening, and the piston rod protrudes outside the piston cylinder body from the piston rod opening.

* * * * *